US010598196B2

(12) United States Patent
Jorgensen et al.

(10) Patent No.: US 10,598,196 B2
(45) Date of Patent: Mar. 24, 2020

(54) REDUCED NOISE RECIPROCATING PNEUMATIC MOTOR

(71) Applicant: SHINN FU CORPORATION, Taipei (TW)

(72) Inventors: Ryan Jorgensen, Blue Springs, MO (US); Fu Jiang Feng, Shanghai (CN)

(73) Assignee: SHINN FU CORPORATION, Taipei (TW)

( * ) Notice: Subject to any disclaimer, the term of this patent is extended or adjusted under 35 U.S.C. 154(b) by 46 days.

(21) Appl. No.: 15/856,563

(22) Filed: Dec. 28, 2017

(65) Prior Publication Data

US 2019/0203744 A1 Jul. 4, 2019

(51) Int. Cl.

| | |
|---|---|
| ***F15B 21/00*** | (2006.01) |
| ***F04B 39/00*** | (2006.01) |
| ***F04B 39/12*** | (2006.01) |
| *F04B 35/00* | (2006.01) |

(52) U.S. Cl.

CPC ..... *F15B 21/008* (2013.01); *F04B 39/0038* (2013.01); *F04B 39/12* (2013.01); *F04B 35/00* (2013.01); *F15B 2211/7052* (2013.01)

(58) Field of Classification Search

CPC ..... F15B 21/008; F04B 9/125; F04B 9/1253; F04B 9/127; F04B 39/0038; F04B 39/0055; F04B 53/001; F01L 21/04

See application file for complete search history.

(56) References Cited

U.S. PATENT DOCUMENTS

| | | | | |
|---|---|---|---|---|
| 3,597,121 A * | 8/1971 | McClocklin | F04B 9/127 91/227 |
| 5,341,723 A | 8/1994 | Hung | |
| 6,012,377 A | 1/2000 | Hung | |
| 6,109,387 A * | 8/2000 | Boretti | F01N 1/082 181/217 |
| 6,923,348 B2 * | 8/2005 | Grach | F16N 11/10 92/181 R |
| 2002/0117049 A1 * | 8/2002 | Wang | F04B 9/125 91/422 |
| 2015/0322973 A1 * | 11/2015 | Villar | F15B 13/026 91/297 |

OTHER PUBLICATIONS

BVA Hydraulics High Pressure Industrial Hydraulic Equipment, J18124 12 Ton Air/Manual Bottle Jack, http://www.ovahydraulics.com/ProductDetails/BVA%20Hydraulics/12TonAirManualBottleJack/J18124/915.

* cited by examiner

*Primary Examiner* — Michael Leslie
(74) *Attorney, Agent, or Firm* — Lathrop GPM LLP

(57) ABSTRACT

A reduced-noise pneumatic motor has a housing with a cap disposed at a first end, the cap having an air inlet; a base disposed at a second end, the base having an air outlet hole formed therein and configured to at least partially receive a noise damping system, and a piston pump extending therethrough; and bolts extending from the cap to the base to secure the cap and the base to the housing. A pneumatic piston is disposed within the housing, and includes a shuttle valve situated within a central bore of the pneumatic piston. A piston rod has a first end extending into the piston pump and a second end secured to a spring which biases the piston rod against the pneumatic piston.

16 Claims, 11 Drawing Sheets

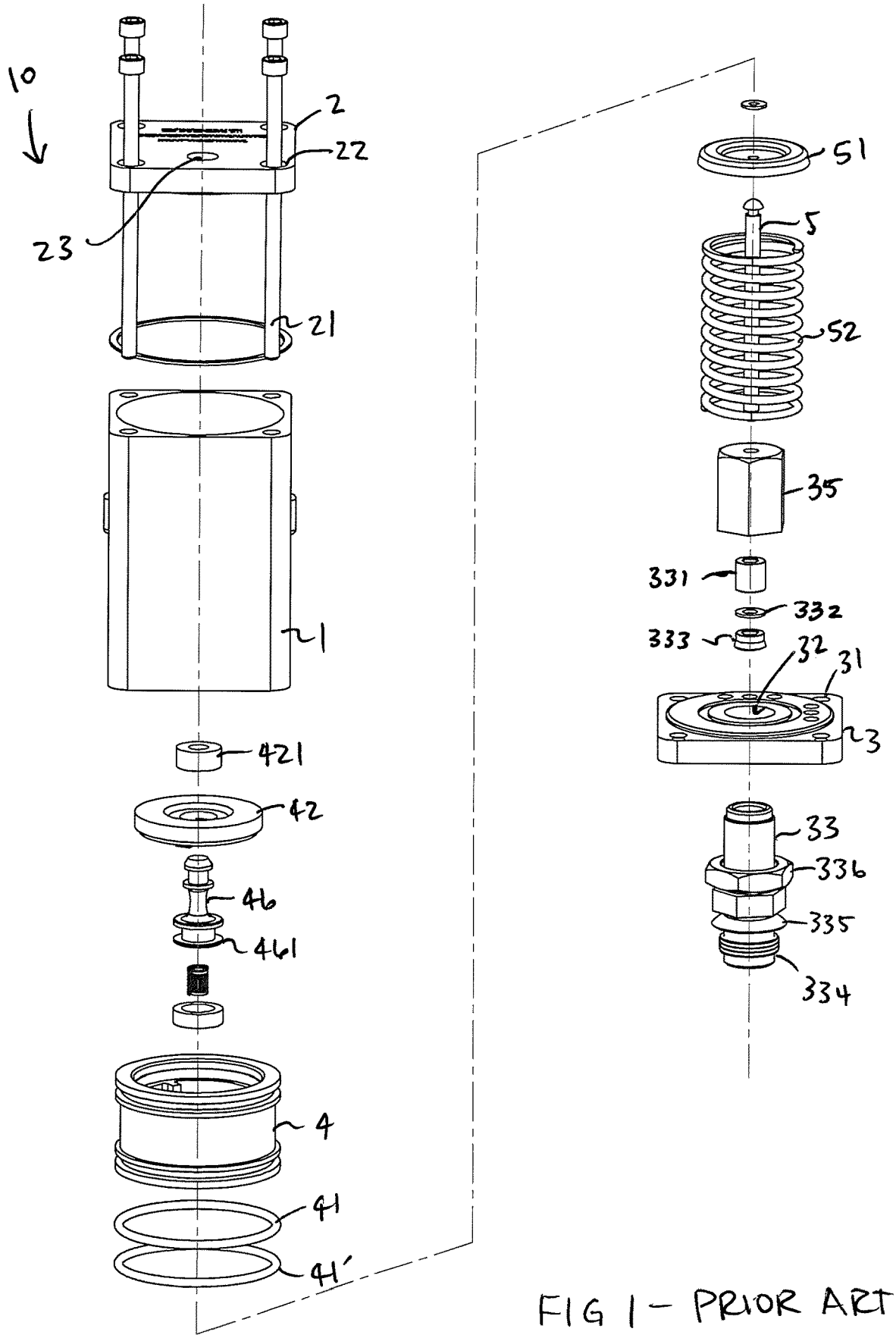
FIG 1 - PRIOR ART

REDUCED NOISE RECIPROCATING PNEUMATIC MOTOR

FIELD OF THE INVENTION

The invention relates to a reciprocating pneumatic motor. More specifically, the invention relates to a pneumatic motor having reduced noise as compared to prior art pneumatic motors.

BACKGROUND

Pneumatic motors are well known in the industry. Typically, pneumatic motors include a cylinder head, a cylinder, a first piston housing, a second piston housing, a piston, and a piston rod. Air is received into an inlet at the cylinder head and the piston rod reciprocates to continuously move the piston right and left. The air flows into the cylinder and the air pressure forces the piston to go down. When the air is vented, the tension from a spring pushes the piston upward. However, one problem with prior-art pneumatic jacks is the noise that accompanies operation of the motor. Disclosed herein are embodiments of air motors that have reduced noise output in comparison with prior art pneumatic motors.

SUMMARY

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere herein.

In one embodiment, a reduced-noise pneumatic motor, includes a housing having a cap disposed at a first end, the cap having an air inlet; a base disposed at a second end, the base having an air outlet hole formed therein configured to at least partially receive a noise damping system, and a piston pump extending therethrough; and bolts extending from the cap to the base to secure the cap and the base to the housing. A pneumatic piston is also disposed within the housing, and includes a shuttle valve situated within a central bore of the pneumatic piston. A piston rod has a first end extending into the piston pump and a second end secured to a spring which biases the piston rod against the pneumatic piston. The air outlet hole has a first portion having a first diameter and a second portion having a second diameter, where the second portion extends partially along the depth of the base. The noise damping system includes a foam member which is received into the second portion of the air outlet hole; a wire mesh component disposed atop the foam member; a retention cap situated atop the wire mesh component; and a bolt that extends through the retention cap and the wire mesh to secure the noise damping system to the base.

In another embodiment, in a reduced-noise pneumatic motor having a housing having a cap disposed at a first end, the cap having an air inlet; a base disposed at a second end, the base having an air outlet hole formed therein, and a piston pump extending therethrough; a pneumatic piston disposed within the housing, the pneumatic piston including a shuttle valve situated within a central bore of the pneumatic piston; and a piston rod having a first end extending into the piston pump and a second end secured to a spring which biases the piston rod against the pneumatic piston; the improvement includes a noise damping system. The noise damping system is configured to engage with the air outlet hole, and includes an air-receiving element. Air exits the pneumatic motor through the air outlet hole, and is received by the air-receiving element, which dampens the sound caused by the air exiting from the pneumatic motor.

In still yet another embodiment, A reduced-noise pneumatic motor has a housing with a cap disposed at a first end, the cap having an air inlet; a base disposed at a second end, the base having an air outlet hole formed therein and configured to at least partially receive a noise damping system, and a piston pump extending therethrough; and bolts extending from the cap to the base to secure the cap and the base to the housing. A pneumatic piston is disposed within the housing, and includes a shuttle valve situated within a central bore of the pneumatic piston. A piston rod has a first end extending into the piston pump and a second end secured to a spring which biases the piston rod against the pneumatic piston.

BRIEF DESCRIPTION OF THE DRAWINGS

FIG. 1 is an exploded perspective view of a pneumatic motor according to an embodiment of the invention.

DETAILED DESCRIPTION

Figure 5:
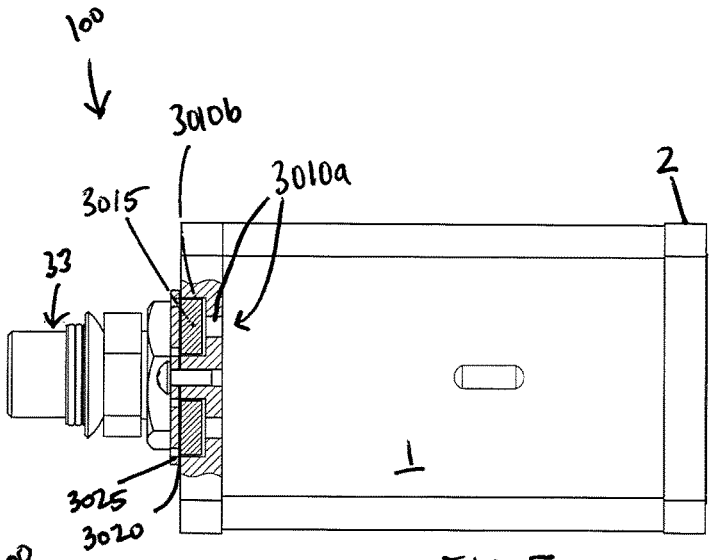
FIG. 5 is a side view of the reduced-noise pneumatic motor of FIG. 3.
Figure 6:
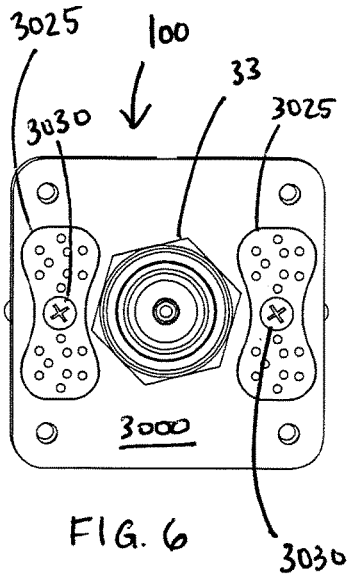
FIG. 6 is a top view of the reduced-noise pneumatic motor of FIG. 4.

FIG. 1 illustrates the basic components of a pneumatic motor. The motor 10 comprises a housing (or cylinder) 1 and a piston 4 with a piston rod 5 disposed therein. A cap 2 and base 3 cover the cylinder 1 and are bolted together via bolts 21. The bolts 21 extend through holes 22 in the cap 2. An air inlet hole 23 is formed into the cap 2 at a select location.

The base 3 has corresponding holes 31 for receiving the bolts 21. The bolts 21 may be screwed into the holes 31 to maintain the bolts 21 in position. An opening 32 formed into the base 3 receives a pump piston housing 33. An inside diameter of an upper portion of the pump piston housing 33 has a bearing 331, a washer 332, and a seal 333 (e.g., a u-cup seal) which extend through the base 3 and lock onto a piston pump cover 35. A lower portion of the piston pump housing 33 has an oil seal 334, a washer 335, and a hex nut 336.

The piston 4 is a substantially cylindrical body having a first seal ring 41 positioned at the top of the piston 4 and a second seal ring 41' positioned at the bottom of the piston 4. A piston cap 42 sits atop an indented surface on the top of the piston 4.

Figure 2:
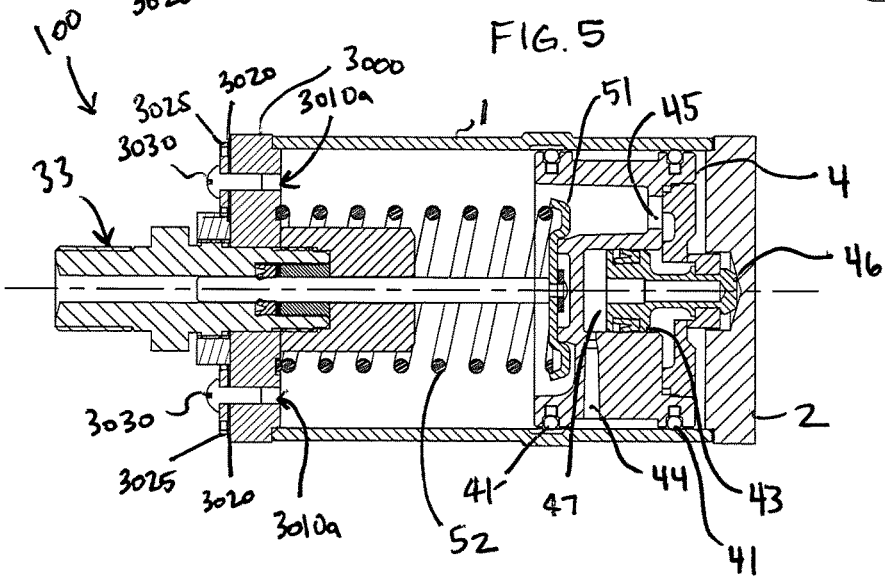
FIG. 2 is a cross-sectional view of a reduced-noise pneumatic motor according to another embodiment of the invention.

As shown in FIG. 2, a central portion of the indented surface has a central hole 43 to which a radial air inlet hole 44 is connected. An air vent hole 45 is located near the central hole 43. A shuttle valve 46 is received by the central hole 43 and operates between the main body of the piston 4 and the piston cap 42. A seal 421 is installed on a portion of the shuttle valve 46 extending from the piston cap 42. The end portion of the shuttle valve 46 has an oil seal 461 which maintains air tightness between the shuttle valve 46 and the bottom of the hole 43. Accordingly, a shuttle compression chamber 47 is formed between the bottom of the shuttle valve 46 and the bottom of the hole 43. The shuttle compression chamber 47 is open to the air inlet hole 44.

One end of the piston rod 5 extends through the piston pump cover 35 into the piston pump 33. The other end locks into a spring cap 51 to which a spring 52 is attached. When assembled, the spring cap 51 abuts the bottom of the piston 4. As is known to those of skill in the art, the spring 52 enables the reciprocating motion of the piston rod 5.

In use, compressed air enters through the air inlet opening 23, which pushes the piston 4 forward inside the housing 1, thereby compressing the spring 52. When the seal ring 41 passes by grooves 11 formed in the housing 1 (FIG. 2), a gap is formed which allows air to pass through the air inlet hole 44 and into the shuttle compression chamber 47. The pressure on the shuttle valve 46 due to the air entering the shuttle compression chamber 47 causes the shuttle valve 47 to move up inside the central hole 43, which causes the air vent hole 45 to open up. Air travels through the air vent hole 45 and into the space where the spring 52 is situated within the housing 1, and eventually through holes formed in the base 3. The venting lowers the pressure to a point that the tension of the coiled spring 52 pushes the piston rod 5 back to its original state. Any remaining air in the compression chamber 47 passes through the gap between the second seal ring 41' and the guided grooves 11, and is vented out through the base 3. When the air in the compression chamber 47 is completely vented, the shuttle valve 46 automatically shuts off and returns to its original position. It is well understood that the compressed air going in and the venting occur simultaneously during operation of the motor.

A significant amount of noise can be generated by the motor during its operation. This is detrimental for several reasons, not the least of which is the undesirable effects that it can have on the hearing of a person in close proximity to the motor. Accordingly, a motor configuration having reduced noise levels without reducing the efficiency of the motor is desirable. In one embodiment, shown in FIG. 3, noise output of the pneumatic motor 100 is reduced by more than ten decibels, which is a decrease of nearly 12%. This noise reduction is significant, considering that the motor may run for hours at a time near the user.

The motor 100 may be substantially to the motor 10 described above, except as is set forth below. Reference numerals corresponding to components of the motor 100 are used to identify the same or substantially the same components in the motor 100. In the embodiment shown in FIG. 3, the motor 100 includes a base 3000 similar to the base 3 of the motor 100 in overall shape. However, here, the base 3000 is configured to receive a noise damping system such that the audible footprint of the motor 100 is reduced.

One or more openings 3010 are formed into the base 3000. A first portion **3010*a* of the opening 3010 having a first diameter extends from an inside surface 3005 through to an outside surface 3007 of the base 3000. In an embodiment, the diameter of the first portion 3010*a* of the opening 3010 is between about 2 and 4 mm, and preferably about 3 mm. A second portion 3010*b* of the opening 3010 may extend partially inward from the outside surface 3007 toward the inside surface 3005 of the base 3000. In an embodiment, the diameter of the second portion 3010*b* of the opening 3010 is between about 10 and 15 mm, and preferably about 12 mm. The second portion 3010*b* may be recessed approximately 4 to 6 mm deep, measured from the outside surface 3007 of the base 3000**.

Figure 3:
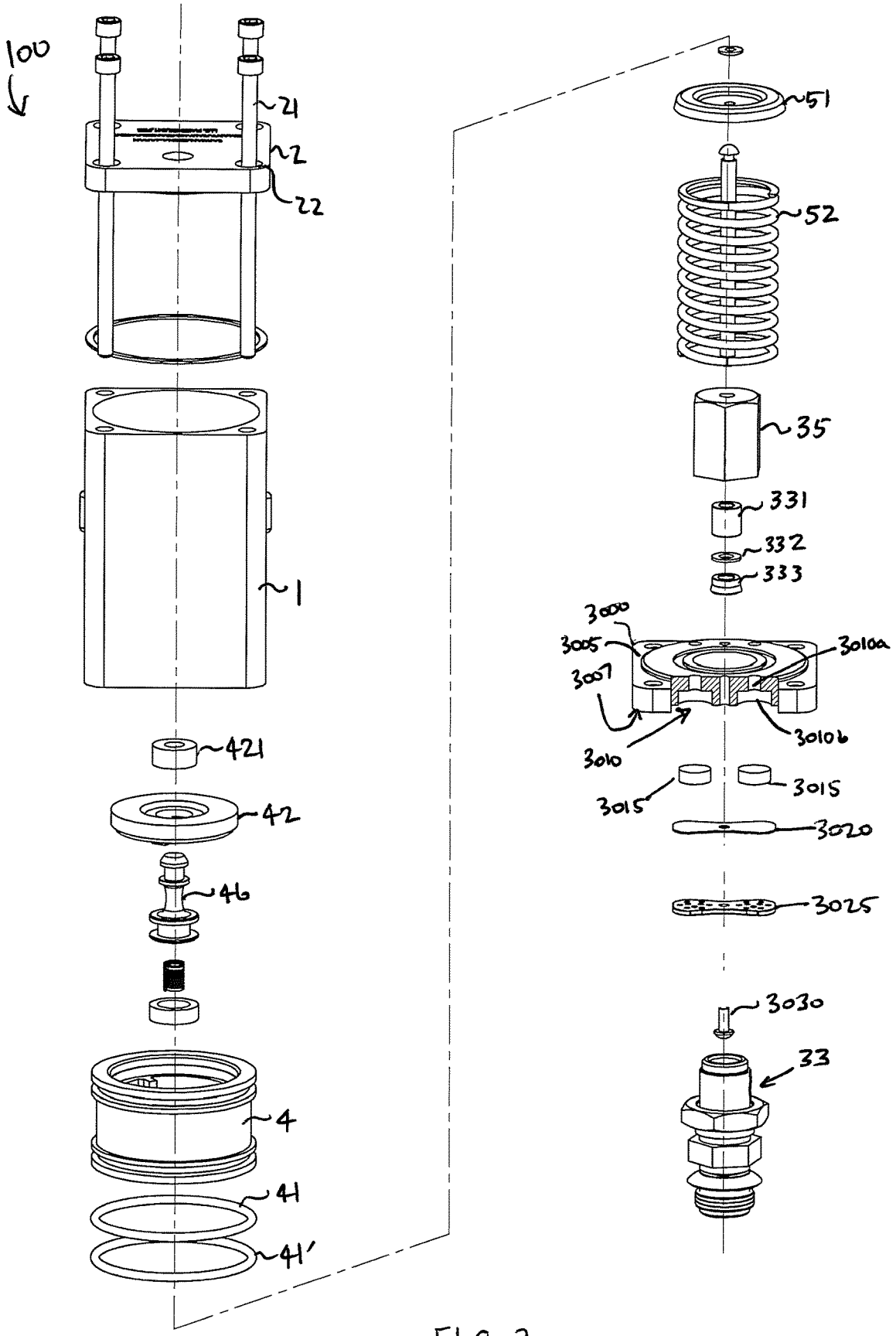
FIG. 3 is an exploded perspective view of a reduced-noise pneumatic motor according to still another embodiment of the invention.
Figure 4:
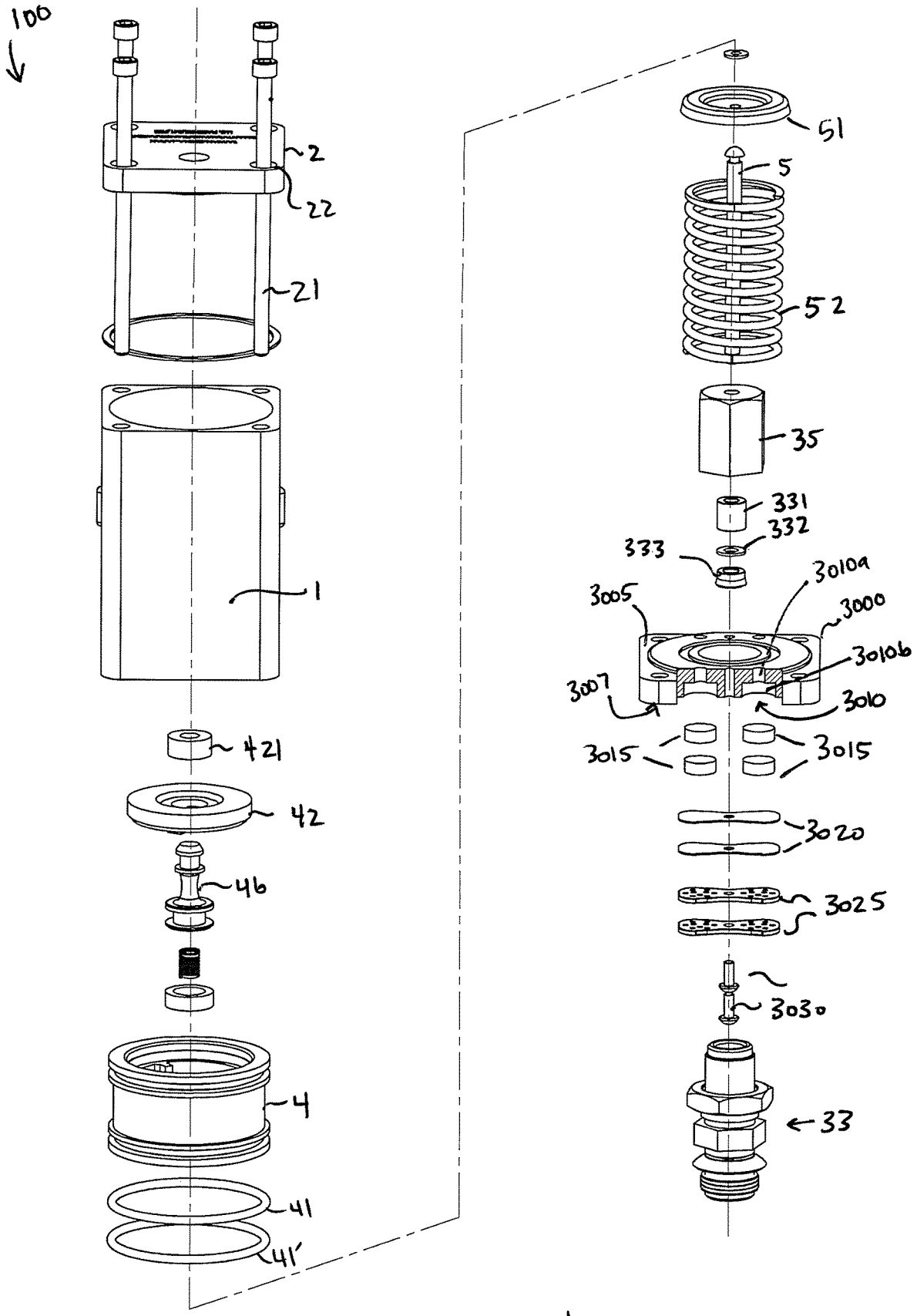
FIG. 4 is an exploded perspective view of a reduced-noise pneumatic motor according to still yet another embodiment of the invention.
Figure 7:
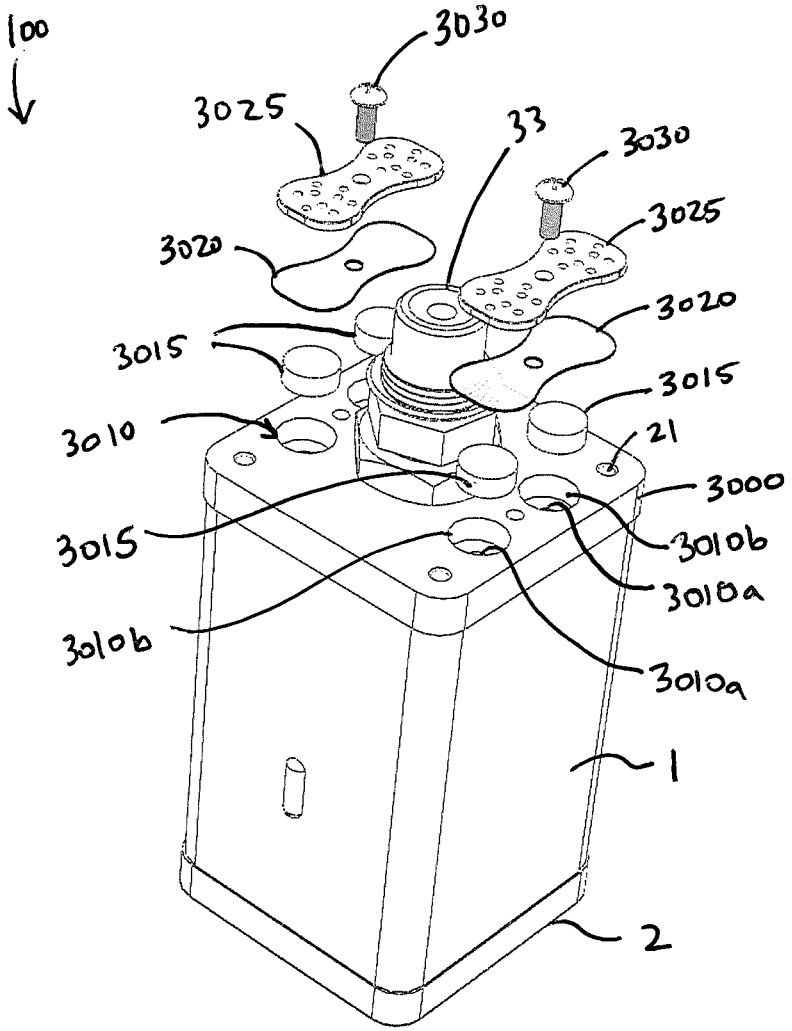
FIG. 7 is a partially exploded perspective view of a reduced-noise pneumatic motor of FIG. 4.
Figure 8:
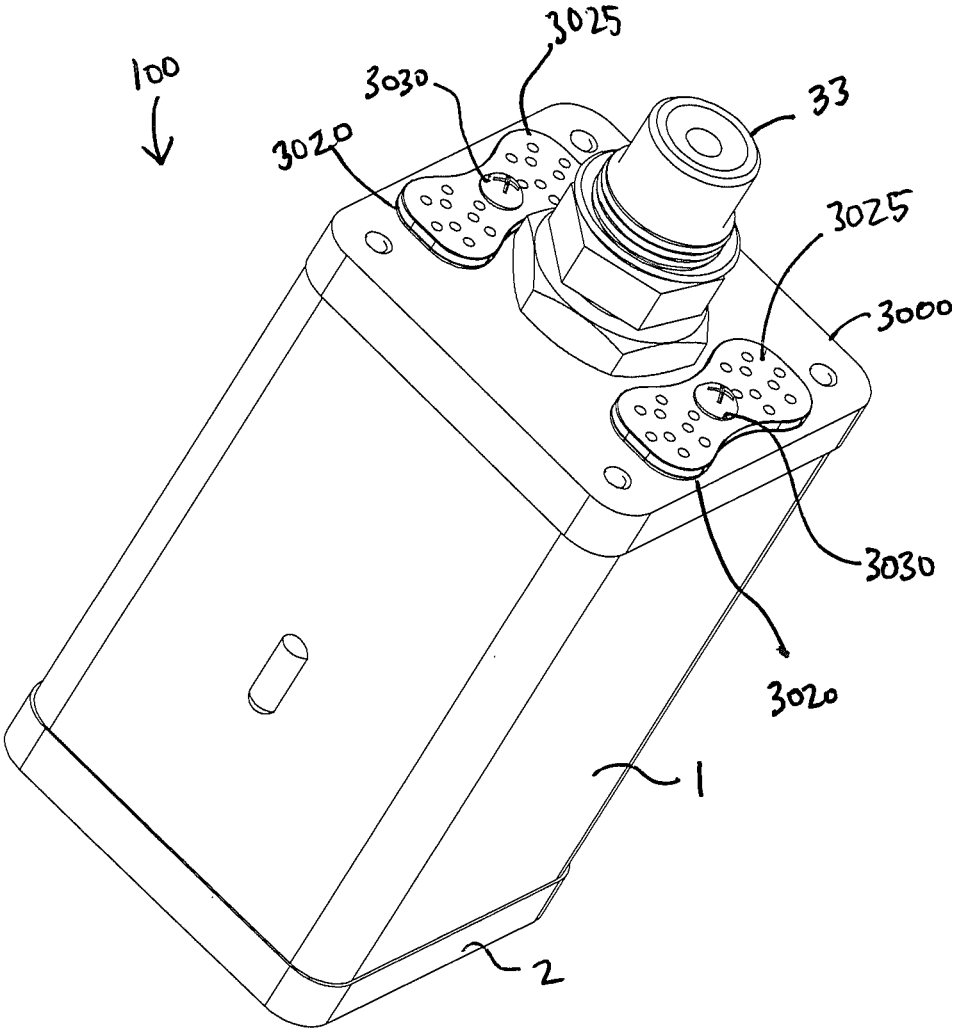
FIG. 8 is a perspective view of the reduced-noise pneumatic motor of FIG. 4.

In the embodiment shown in FIG. 3, there are two openings 3010 in the base. The openings 3010 are spaced apart along an edge of the base 3000. However, additional openings 3010 may be included, as necessary, so long as efficient operation of the air motor is maintained. Likewise, fewer openings 3010 may be included, as so long as efficient operation of the air motor is maintained, and the noise-reduction is not compromised. In embodiments, the openings 3010 are provided in pairs along one or more edges of the base 3000.

A formed piece of foam (or other similar material, such as a sponge) is inserted into the opening second portion **3010*b***. The foam may be any material that is sufficiently porous and flexible that the air can pass through without significant impedance. For example, materials which may be appropriate include but are not limited to polyurethane (polyester), polyethylene, latex rubber foam, high density charcoal (e.g., Supreem foam), evlon, rebond foam, closed-cell foams, etc. In embodiments, the foam material may be selected based on the foam's ability to absorb sound.

A wire mesh 3020, having an elongated shape is placed adjacent the outside surface 3007 such that it covers the foam piece(s) 3015. The wire mesh 3020 protects the foam pieces 3015 and keeps them in place within the base 3000. A retention cap 3025, having a shape substantially similar to the wire mesh 3020, is situated atop the wire mesh 3020. The retention cap 3025 includes a plurality of holes, through which air may be exhausted. The retention cap 3025 and the wire mesh 3020 (and therefore the foam pieces 3015) are secured to the base 3000 via a mechanical fastener 3030, such as a screw.

In use, the air exits through the motor 100 as described above. Here, however, the foam pieces 3015 absorb a portion of the sound caused by the air escaping from the motor 100. However, because of the porous nature of the foam 3015, the air is not prevented from exiting the motor 100. Likewise, the wire mesh 3020 and the retention cap 3025 include holes which allow the exiting air to escape. Accordingly, the efficiency of the motor 100 is not reduced; however, the noise due to operation of the motor 100 is decreased.

In another embodiment, illustrated in FIGS. 4 and 6-8, the base 3000 includes additional openings 3010. Here, there are four openings 3010, and as described above, four pieces of foam 3015 are deposited in each of the openings 3010. Two wire mesh 3020 and retention caps 3025 are situated atop the respective openings 3010 and secured to the base 3000, as described above. Air is therefore allowed to exit through the four openings 3010 during operation of the motor 100.

Figure 9:
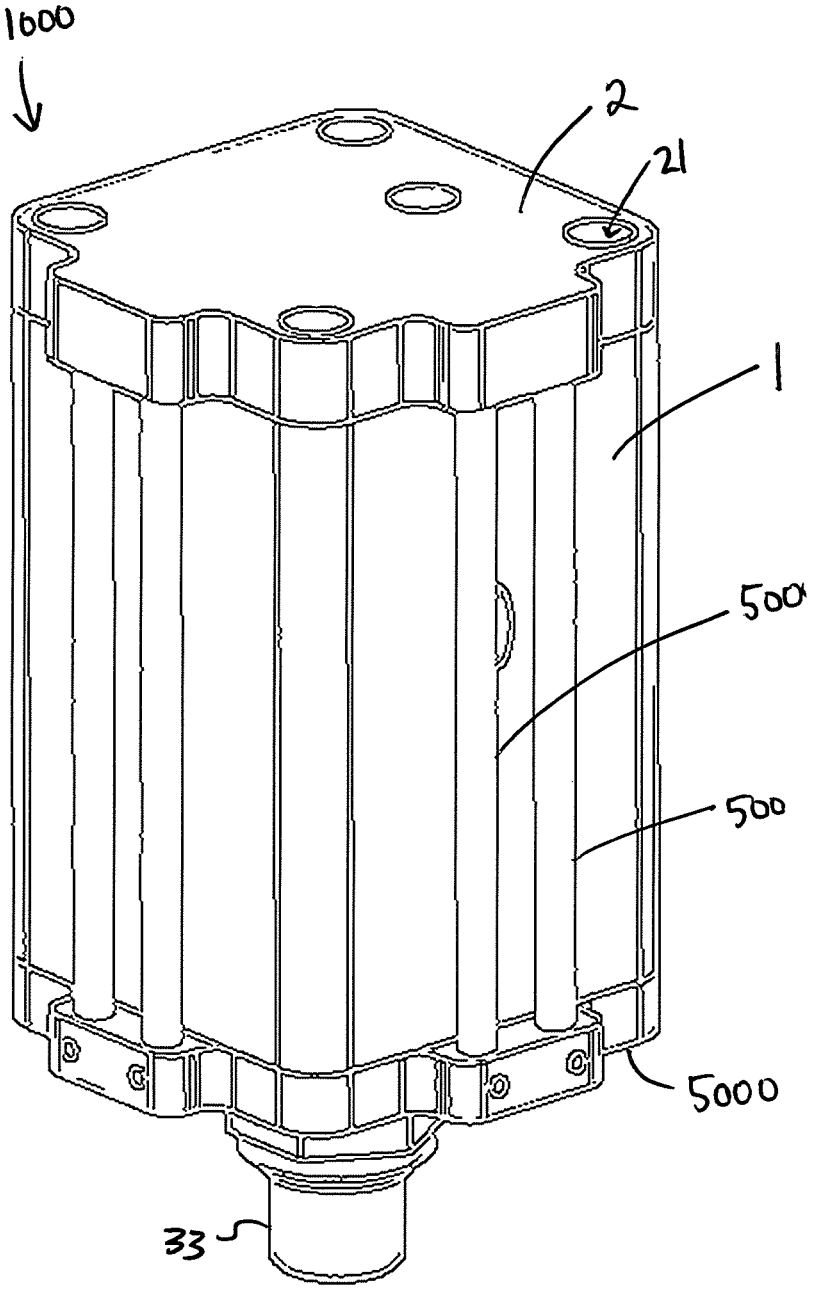
FIG. 9 is a cross-sectional view of a reduced-noise pneumatic motor according to a still further embodiment of the invention.
Figure 10:
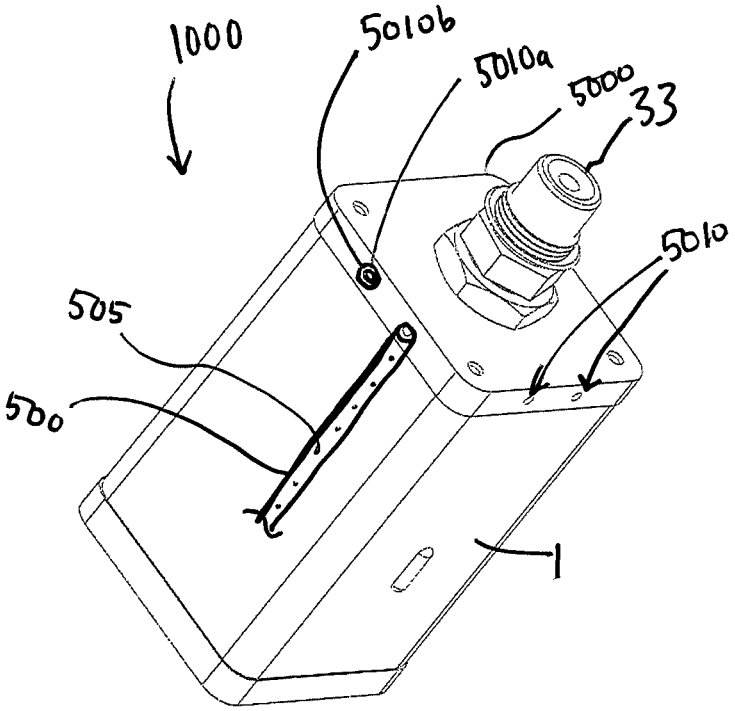
FIG. 10 is a perspective view of the reduced-noise pneumatic motor according to the embodiment of FIG. 9.
Figure 13:
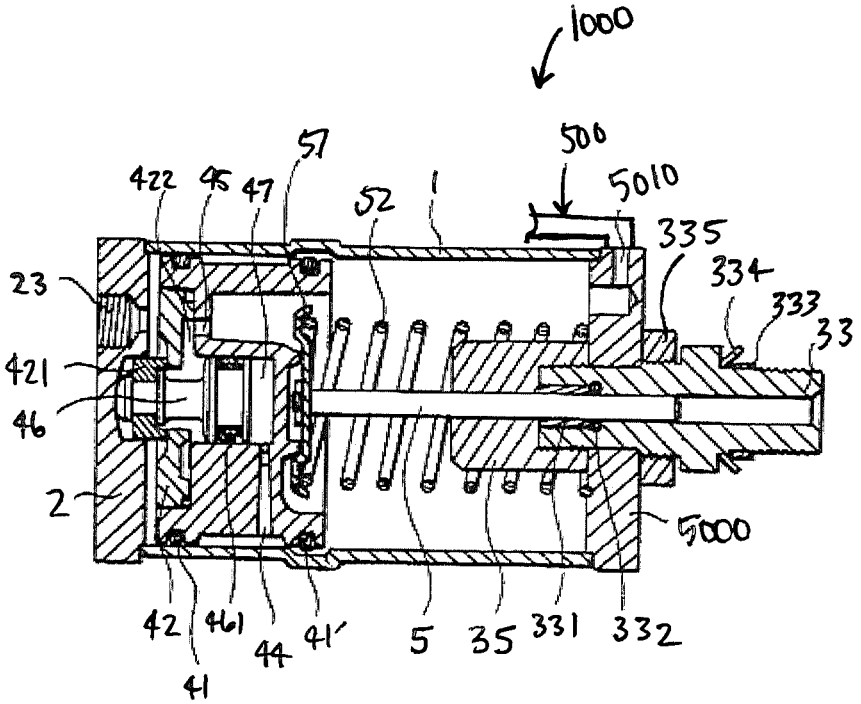
FIG. 13 is a cross-sectional view of the reduced-noise pneumatic motor according to FIG. 10.

In still another embodiment, a motor 1000 is substantially similar to the motor 100, as illustrated in FIG. 9. Reference numerals corresponding to components of the motor 1000 are used to identify the same or substantially the same components in the motor 100. In the embodiment shown in FIG. 9, the motor 100 includes a base 5000 similar to the bases 3 and 3000. Here, however, air exits through L-shaped openings 5010 in the base 5000 (FIG. 13). Those of skill in the art shall understand that the openings 5010 are not required to be L-shaped, and that the openings 5010 may have any configuration that allows the air to exit from the motor 1000.

At the outside edge of the base 5000, the diameter of the openings 5010 may be enlarged in order to receive a tube 500, as described below. Accordingly, the openings 5010 may have a first portion 5010*a* with a first diameter, and a second portion 5010*b* with a second diameter, the second diameter being larger than the first diameter. The second diameter 5010*b* of the opening 5010 may be substantially the same as the outside diameter of tubing 500 which may be inserted into the openings such that the tubing 500 is maintained in place in the openings 5010 at least during operation of the motor 1000. Optionally, the tubing 500 may be adhered inside the opening 5010 for a more permanent connection.

Figure 11:
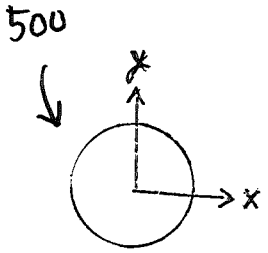
FIG. 11 is a top view of a piece of tubing according to the embodiment of FIG. 10.
Figure 12:
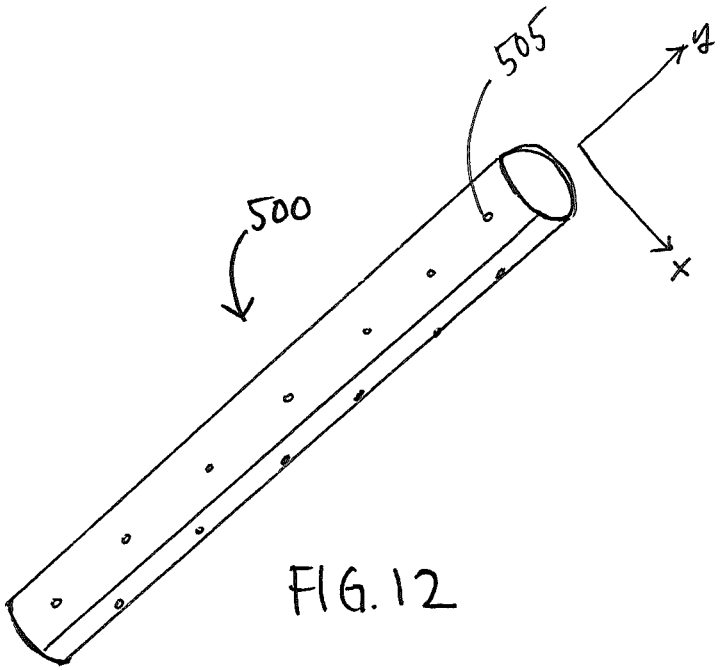
FIG. 12 is a perspective view of a piece of tubing according to the embodiment of FIG. 10.

The tubing 500 may be any semi-hard plastic tubing, having a diameter of approximately 0.25 inches, although other materials and sizes may additionally or alternately be appropriate and acceptable. Holes 505 may be formed along the length of the tubing 500. In one embodiment, holes 505 in the tubing 500 are formed along two perpendicular planes (e.g., along the x- and y-planes illustrated in FIGS. 11 and 12). The holes 505 in the x-plane may be offset from the holes 505 in the y-plane, as shown in FIG. 12. The holes 505 in the tubing 500 may have a diameter of approximately 1/16". One end of the tubing 500 (e.g., the end opposite the end inserted into the opening 5010) is closed off such that air entering into the tubing 500 is forced out of the holes 505 formed into the length thereof. In one embodiment, the tubing 500 may simply be clamped together at one end. In another embodiment, such as that illustrated in FIG. 9, the tubing 500 may be inserted into a tube receiving member which may close off the end of the tubing 500 such that air may only exit through the holes 505.

In use, as the air exits the motor 1000 through the openings 5010, it travels down the length of the tubing 500, and exits through the holes 505 formed in the tubing 500. Due to the lengthened path that the air has to exit the motor via the tubing 500, the overall noise of the air motor is reduced.

Figure 14:
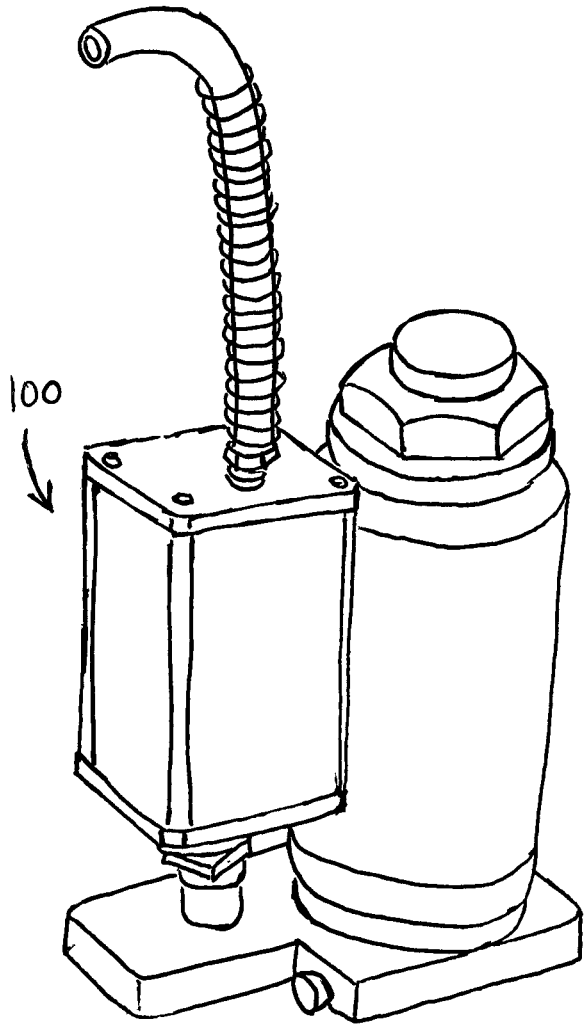
FIG. 14 is a perspective view of a reduced-noise pneumatic motor shown in use with a hydraulic jack according to one exemplary use of the invention.

Generally, the air motors 10, 100, 100 described herein are used with hydraulic jacks, as shown in FIG. 14. However, as those of ordinary skill shall understand, the air motors 10, 100, and/or 1000 can be used anywhere that an air motor would be appropriate.

Many different arrangements of the described invention are possible without departing from the spirit and scope of the present invention. Embodiments of the present invention are described herein with the intent to be illustrative rather than restrictive. Alternative embodiments will become apparent to those skilled in the art that do not depart from its scope. A skilled artisan may develop alternative means of implementing the disclosed improvements without departing from the scope of the present invention.

Further, it will be understood that certain features and subcombinations are of utility and may be employed without reference to other features and subcombinations and are contemplated within the scope of the claims. Not all steps listed in the various figures and description need to be carried out in the specific order described. The description should not be restricted to the specific described embodiments.

What is claimed is:

1. A reduced-noise pneumatic motor, comprising:

a housing having a cap disposed at a first end, the cap having an air inlet; a base disposed at a second end, the base having an air outlet hole formed therein configured to at least partially receive a noise damping system, and a piston pump extending therethrough; and bolts extending from the cap to the base to secure the cap and the base to the housing;

a pneumatic piston disposed within the housing, the pneumatic piston comprising a shuttle valve situated within a central bore of the pneumatic piston; and a piston rod having a first end extending into the piston pump and a second end secured to a spring which biases the piston rod against the pneumatic piston;

wherein:

the air outlet hole comprises a first portion having a first diameter and a second portion having a second diameter, the second portion extending partially along the depth of the base; and the noise damping system comprises:

a foam member, the foam member being received into the second portion of the air outlet hole;

a wire mesh component disposed atop the foam member;

a retention cap situated atop the wire mesh component; and a bolt extending through the retention cap and the wire mesh to secure the noise damping system to the base.

2. The pneumatic motor of claim 1, wherein the retention cap has a plurality of openings formed therein to allow air to pass therethrough.

3. The pneumatic motor of claim 2, wherein the base comprises-a two air outlet holes arranged side-by-side, and wherein the wire mesh and retention cap are configured to cover the foam members received into both of the air outlet holes.

4. The pneumatic motor of claim 2, wherein the base comprises a plurality of air outlet holes, each outlet hole receiving a foam member, the foam member being secured to the base via a bolt inserted through a wire mesh and retention cap situated atop the foam member.

5. The pneumatic motor of claim 4, wherein the plurality of air outlet holes are arranged in pairs, and wherein each wire mesh and retention cap is configured to cover the foam pieces received by the pair of air outlet holes.

6. The pneumatic motor of claim 1, wherein the foam is one of: polyurethane (polyester), polyethylene, latex rubber, and high density charcoal.

7. The pneumatic motor of claim 1, wherein the first diameter is smaller than the second diameter.

8. The pneumatic motor of claim 7, wherein the first diameter is about 3 mm, and wherein the second diameter is about 12 mm, the second portion being recessed approximately 5 to 6 mm from an outside surface of the base.

9. In a reduced-noise pneumatic motor comprising a housing having a cap disposed at a first end, the cap having an air inlet; a base disposed at a second end, the base having an air outlet hole formed therein, and a piston pump extending therethrough; a pneumatic piston disposed within the housing, the pneumatic piston comprising a shuttle valve situated within a central bore of the pneumatic piston; and a piston rod having a first end extending into the piston pump and a second end secured to a spring which biases the piston rod against the pneumatic piston; the improvement comprising:

a noise damping system configured to engage with the air outlet hole, the noise damping system comprising an air-receiving element, wherein air exits the pneumatic motor through the air outlet hole, and is received by the air-receiving element, the air receiving element dampening the sound caused by the air exiting from the pneumatic motor;

wherein:

the air-receiving element comprises a section of tubing, the tubing having a first end inserted into the air outlet hole and a second closed end, and a plurality of holes formed along the length of the tubing; and the holes in the tubing are formed along the tubing in two perpendicular planes, the holes in the first plane being offset from the holes in the second plane.

10. The pneumatic motor of claim 9, wherein the air outlet hole comprises a first portion having a first diameter and a second portion having a second diameter, the second portion being recessed in the base.

11. The pneumatic motor of claim 10, wherein the air-receiving element comprises a piece of foam, the piece of foam being positioned inside the second portion of the air outlet hole.

12. The pneumatic motor of claim 11, wherein a wire mesh is disposed atop the foam piece, and a retention cap is positioned adjacent the wire mesh, the wire mesh and retention cap being secured to the base with a mechanical fastener.

13. The pneumatic motor of claim 12, wherein the base comprises a plurality of air outlet holes, each outlet hole being equipped with a piece of foam.

14. A reduced-noise pneumatic motor, comprising:

a housing having a cap disposed at a first end, the cap having an air inlet; a base disposed at a second end, the base having an air outlet hole formed therein and configured to engage with a noise damping system, and a piston pump extending therethrough; and bolts extending from the cap to the base to secure the cap and the base to the housing;

a pneumatic piston disposed within the housing, the pneumatic piston comprising a shuttle valve situated within a central bore of the pneumatic piston; and a piston rod having a first end extending into the piston pump and a second end secured to a spring which biases the piston rod against the pneumatic piston wherein:

the noise damping system comprises a tubing member having a first end inserted into the air outlet hole and a second closed end, and a plurality of holes formed along the length thereof and along two perpendicular planes of the tubing.

15. The pneumatic motor of claim 14, wherein the noise damping system comprises:

a foam member, the foam member being received into the second portion of the air outlet hole; and a retention plate disposed atop the foam member and secured to the base via a mechanical fastener.

16. The pneumatic motor of claim 15, wherein the base comprises a plurality of air outlet holes, each air outlet hole engaging with a noise damping system.

* * * * *